United States Patent [19]

Shames et al.

[11] Patent Number: 4,944,050

[45] Date of Patent: Jul. 31, 1990

[54] COMBINED SHOWER SPLASH GUARD AND SHOWER CURTAIN HOLDER

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 357,125

[22] Filed: May 26, 1989

[51] Int. Cl.[5] ..... A47K 3/22

[52] U.S. Cl. ..... 4/609; 4/559; 4/605; 4/608; 160/349.2; D23/307

[58] Field of Search ..... 4/609–610, 4/608, 607, 605, 558, 661, 559; 160/349.1, 349.2, DIG. 6; D23/303–307

[56] References Cited

U.S. PATENT DOCUMENTS

| | | | |
|---|---|---|---|
| D. 253,188 | 10/1979 | Bougus | D23/307 |
| D. 297,454 | 8/1988 | Walton | D23/307 |
| 3,724,000 | 4/1973 | Eakman | 4/609 |
| 3,855,642 | 12/1974 | Blitch | 4/609 |
| 3,879,806 | 4/1975 | Armstrong | 4/610 |
| 3,984,880 | 10/1976 | Schrameyer | 4/609 |
| 4,189,790 | 2/1980 | Masters, III | 4/609 X |
| 4,759,087 | 7/1988 | Zeilinger | 4/608 |
| 4,771,517 | 9/1988 | Bonanno | 4/609 X |
| 4,825,481 | 5/1989 | Lomberger | 4/608 |

*Primary Examiner*—Henry K. Artis
*Attorney, Agent, or Firm*—Norman Lettvin

[57] ABSTRACT

A combined shower splash guard member with a shower curtain holder is provided by a molded, generally triangularly-shaped, and modified, one piece body having two straight legs that intersect at a vertex of the triangle, and a third, web-like leg that extends between the free ends of said first two legs of the splash guard. Means for holding the one piece body to a mounting for the body is provided by an adhesive strip of a length to be secured to the entire outer surface of the two straight legs of the splash guard. To accommodate the departure from the desired perpendicularity of the legs of the splash guard, a gusset means is provided in the web of the splash guard which permits the web of the one-piece body to be varied from its normally intended size and shape.

A shower curtain holding structure is provided in the molded web of the shower splash guard, by providing an aperture means that is formed through said web, and providing a selectively, manually movable, cantilevered, curtain-tensioning member to be located within said through-aperture formed in the web of the shower splash guard, so that manual movement of the tensioning member to a curtain-tensioning position may be used to effect friction holding of the shower curtain by said curtain-tensioning member and by the aperture means defined in the web of the shower splash guard member.

5 Claims, 1 Drawing Sheet

FIG. 1
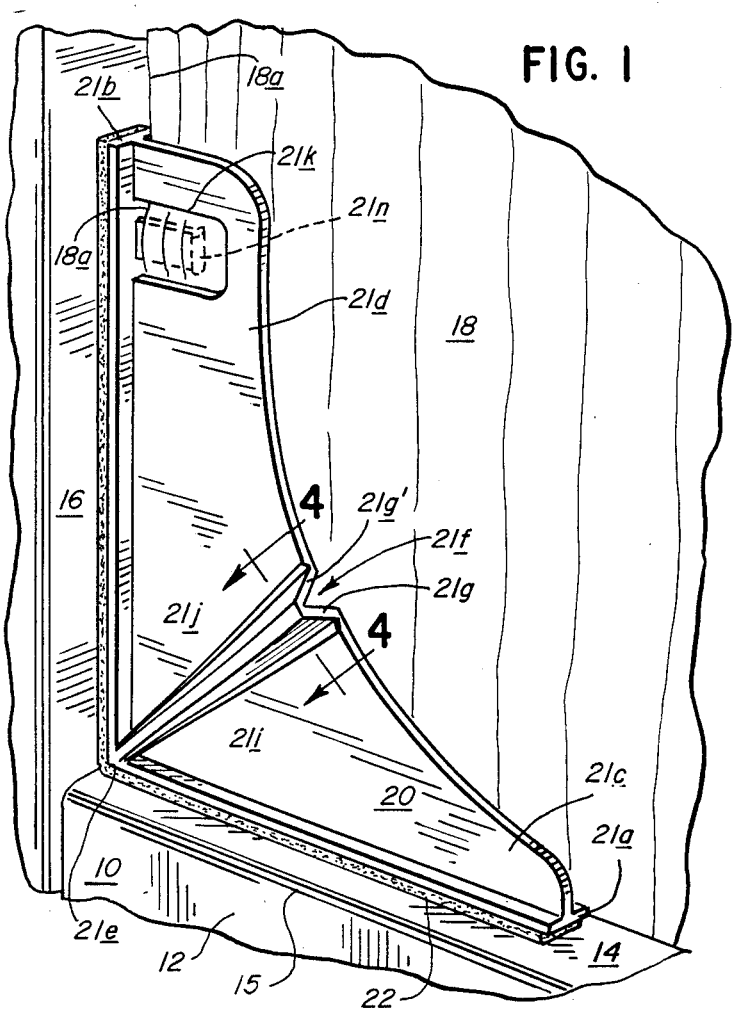
FIG. 4
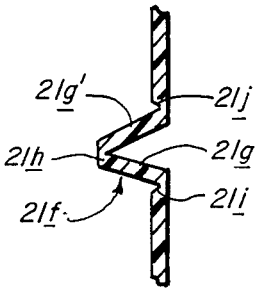
FIG. 5
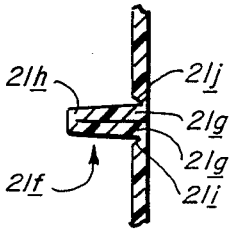
FIG. 6
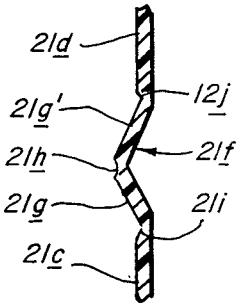
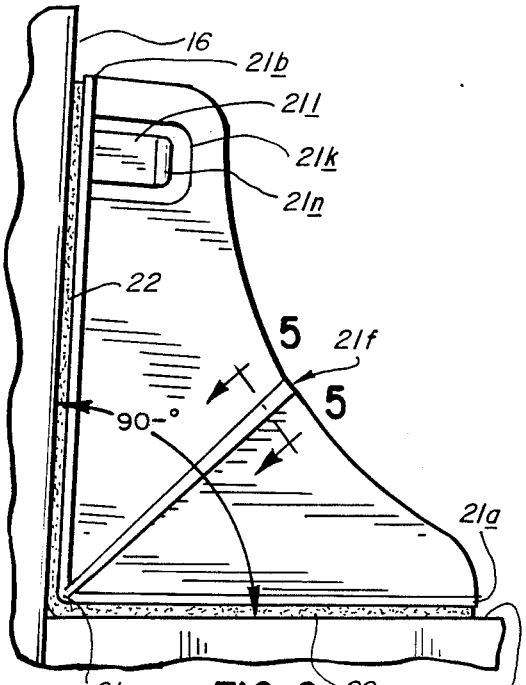
FIG. 2
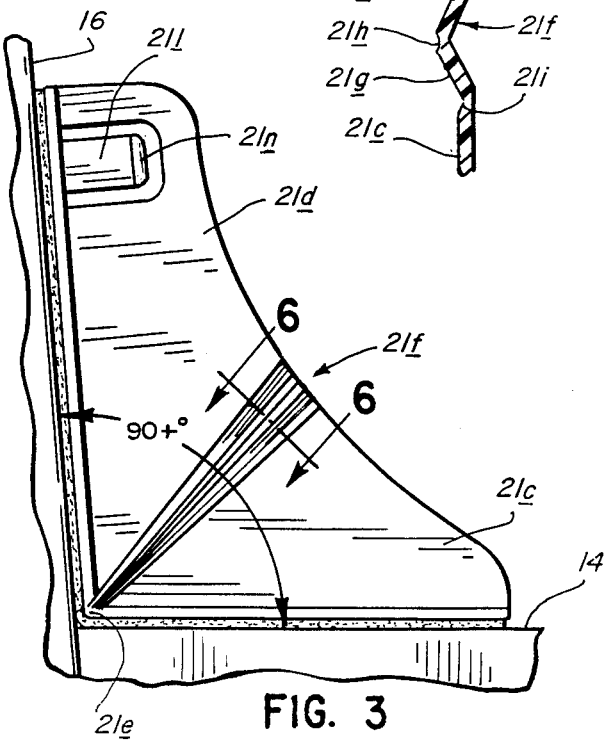
FIG. 3

COMBINED SHOWER SPLASH GUARD AND SHOWER CURTAIN HOLDER

FIELD OF THE INVENTION

This invention relates to a new, useful, and improved construction of a combined shower-splash guard and a shower curtain holder, for use with a shower tub and the like.

BACKGROUND OF THE INVENTION

A shower tub, or tub-like enclosure, for accommodating people who use a shower bath either in their home, or as provided in a hotel, or a motel, are well known in the art, and are produced and used, with a variety of configurations and with accessories for installation and use.

A shower tub is frequently provided as a rectangular body that is constructed and intended to have its upright sides interfit into or with a tub-receiving recess therefor, and/or to abut other structures with which said tub is to interfit.

However, because of many known problems including: the nature of a shower spray; the size of the tub; the assembly, or installation, of the tub cooperating with the adjacent walls of the bathroom in which the tub is installed, and other such factors, the fact is that water splash, discharging outwardly of the tub, when a person is showering, remains a common, and annoying, occurrence.

Attempts have been made, in the past, to reduce, the water splash problem that occurs when a person is showering. Most such attempts involve use of a shower curtain, because it is relatively inexpensive, and it continues to be a decorative, desirable, and functional accessory.

This application discloses a new and improved guard member against shower splash, and one that is constructed and arranged to be used as an accessory for use with a bathroom shower's structural arrangement that includes: a tub; at least one bathroom wall with which the tub cooperates; and a means for restraining, or holding, in a desired position, a shower curtain that is usually provided in association with the bathroom's shower structure for reducing splash from the shower.

Because different work crews may be responsible for an installation, or construction, of the bathroom walls of a habitation, be it in a home, or in a hotel or motel, it is possible, and indeed probable, that the installation of the shower-tub structure will not be precisely perpendicular to the shower enclosure. This factor, itself, contributes to increased splash of water outwardly, onto the floor adjacent the shower-tub, because escaping water most frequently occurs where the shower curtain fails to abut a surface to effect a seal.

Past experience has established that not all possible water splash problems, associated with a shower-tub, may be resolved by merely providing a free hanging shower curtain for use with a shower-tub enclosure for a bathroom.

Therefore, a first, and principal, object of this invention is to provide a new and improved shower-splash guard construction for use with one or both of (a) an usual shower tub enclosure and (b) the existing shower curtain, wherein said splash guard is constructed and arranged to be mounted as an accessory to the usual shower-tub installation, and with said accessory being provided with adjustable character of such a nature as to accommodate itself to variations in construction that may exist between the tub enclosure and the walls of the shower stall enclosure.

Another object of this invention is to provide a new and improved shower-splash guard construction for use with a shower-tub enclosure, and for cooperative use with the existing shower curtain, and wherein the splash guard is constructed and arranged to be mounted as an accessory to the shower-tub installation, and with the accessory being provided with adjustable character, of such a nature as to accommodate itself to variations in structural arrangements that could exist between a tub's enclosure and the adjacent end wall of the shower stall enclosure.

Still another object of this invention is to provide an improved shower-splash guard, with means thereon providing for receiving and holding, in a selected position relative to the shower splash guard, a curtain that has been already, or previously, provided for use with the shower stall, or with a shower-tub enclosure.

A further object of this invention is to provide a new and improved structure, of simple unitary construction, that is useful in providing means for alleviating the condition known as shower-splash.

Still another object of this invention is to disclose and provide a new, useful, and improved construction for a shower-splash guard that is characterized by it novelty, versatility, and effectiveness in combating various problems that are known in the art, and some of which will be recounted herein.

This application for patent discloses a simple, new and useful, and inexpensive appliance that permits an individual, such as a "do-it-yourself" installer, to make an installation of a shower curtain restraint, or holder, without requiring professional installation, or requiring the installer to use, or rely upon, special tools.

Further objects and advantages of the novel construction disclosed herein will become apparent to those skilled in the art, as the specification proceeds to describe the invention, its construction, its utility, and a combination of features and advantages that have not been disclosed in prior art.

BRIEF DESCRIPTION OF THE DRAWINGS

FIG. 1 is a fragmentary view showing, in perspective, the installation of one form of our novel shower-splash guard member, positioned in its intended environment and showing the splash guard member attached, in part, a horizontally extending, supporting surface of a shower-tub enclosure, and illustrating generally, how the splash guard member is also secured to an adjacent upright wall surface that extends transversely to and above the horizontal rail and supporting surface to which the horizontal portion of the novel splash guard attaches. FIG. 1 also shows how a portion of an existing shower curtain is to be captured, and held, between a tongue member, and the edges of an opening that is provided in the guard member, with the tongue member being provided as an integral part of the plastic splash guard member;

FIG. 2 is a side elevational view, in somewhat reduced scale relative to FIG. 1, and showing how a gusset-type fold that is provided in a portion of the web of the splash guard of FIG. 1, will be compressed, when the included angle, between horizontal and upright surfaces to which the splash guard member attaches, is less than ninety degrees (90°);

FIG. 3 is a fragmentary side elevational view showing how the gusset-type folded portion of the web of the splash guard shown in FIG. 1, will be expanded, or stretched out, when the included angle between horizontal and upright surfaces, to which different portions of the splash guard member attaches, is greater than ninety degrees (90°);

FIG. 4 is a fragmentary, cross-sectional, view taken substantially on line 4—4 of FIG. 1, illustrating generally, in cross section, the general attitude of the segments of the gusset portion of this invention, when the splash guard is assembled between horizontal and vertical surfaces that have an included angle of about ninety degrees between them, as intended to be illustrated in FIG. 1;

FIG. 5 is another fragmentary, cross-sectional, view, similar to the one shown in FIG. 4, but taken substantially on line 5—5 of FIG. 2, and illustrating generally, in cross section, the segments of the gusset of the splash guard of this invention, when the splash guard is assembled between surfaces that form an angle of less than ninety degrees between them, as illustrated generally in FIG. 2; and FIG. 6 is a fragmentary, cross-sectional, view taken substantially on line 6—6 of FIG. 3, and illustrating generally, in cross section, the segments of the gusset of the splash guard of this invention, when the splash guard member is assembled between horizontal and vertical surfaces that form an angle of more than ninety degrees between them, as illustrated generally in FIG. 3.

DETAILED DESCRIPTION OF THE DRAWING

Referring now to the drawing, there is shown in each of FIGS. 1–3, slightly different view of an environment wherein a shower curtain is being used, and also showing the preferred construction of our new and useful Shower Splash Guard and Shower Curtain Holder that is constructed to provide a means for holding a shower curtain so as to very substantially decrease, if not totally eliminate, shower splash that would normally occur outwardly of the environment in which a person stands when taking a shower in an environment equipped with the invention disclosed in FIGS. 1–6.

Thus, what is shown in the Figures of the drawings includes a fragment of a shower, or bath, tub, generally indicated at 10, which illustrates a portion of an upright wall, 12, of the tub whose uppermost edge surface 14 provides a generally horizontal surface, as is generally provided in bath, or shower, tub constructions. Said uppermost edge 14 of the tub's sidewall is substantially horizontal, and may be rounded along its longitudinal edges 15 which merge with the tub's side walls. A central portion of the upper edge 14 of tub 10 will be horizontal, in varying amounts, some to an extent of about three or more inches in width.

Also indicated in FIG. 1 is an upright, end wall, generally indicated at 16, which is outside the tub 10 and serves as an abutment against which an adjacent end of tub 10 abuts, so that, taken together, the tub 10 and the upright wall 16 partially bound a space in which a person, who is taking a shower, may stand. Also shown in FIG. 1 is an indication of the presence of a shower curtain, 18, which normally will hang downwardly from an upper support (not shown) that will be spaced above the tub 14, and with a lowermost portion of the shower curtain entering into and being located within the tub 10 adjacent the inner surface of the tub side wall 12, that is indicated in FIG. 1.

The shower splash guard and shower curtain holder of this invention, as shown in the drawings, consists of only two parts, one part being a generally triangularly-shaped, molded, plastic body, generally designated at 20, and the second part being an elongated strip, seen in each of FIGS. 1–3, of an adhesive and compressible material, 22, which adheres, preferably, to the entire length of the two straight legs of the triangularly-shaped plastic body 20 and also adheres to a central portion of the upwardly facing, uppermost edge surface 14 of the tub's sidewall 12, and adheres to a portion of the upright endwall 16, as shown in FIG. 1–3.

The said holding tape 22 is a pressure sensitive, foamed tape product, which is compressible and which is provided with a very high bonding, adhesive strength. This foamed tape product whose surfaces are protected by a releasable cover strip, is sold in the USA by the 3-M Company, or an equivalent.

Referring now to the molded plastic body, as seen in FIG. 1, it will be seen that legs 21*a* and 21*b* of the generally triangular body, when viewed on end, each includes a straight leg segment that lies along, and engages, a segment of the adherent strip 22, with stiffening web portions 21*c* and 21*d* lying in a plane that is perpendicular to the adjacent leg segments 21*a* and 21*b*.

The web portions 21*c* and 21*d* of said molded, plastic, body 20 respectively intersect the elongated legs 21*a* and 21*b* about mid-width of each of said elongated legs.

The legs 21*a* and 21*b* of the plastic body intersect at a vertex 21*e*. Extending between legs 21*a* and 21*b* of the plastic body is a web that is divided into two portions 21*c* and 21*d* by a fold structure, generally indicated at 21*f*, in FIGS. 1–3 that serves as a gusset, or pleat. The pleat includes two segments 21*g* and 21*g*′ that join along a pleat edge 21*h*, as seen in FIG. 1 and in FIGS. 4–6.

The pleat extends from vertex 21*e* to the closest, opposite portion, of the free edge of stiffening webs 21*c* and 21*d*. Where the sections of 21*f* and 21*g* of pleat 21*h* join web section 21*c* and 21*d*, grooves 21*i* and 21*j* are provided to accommodate folding of the pleat's sections as shown in FIG. 4–6.

There is provided in web section 21*d* a means for gripping and holding a portion of shower curtain 18. The web portion 21*d* has a window, or opening, 21*k* formed therethrough. Positioned within window 21*k* is a tongue 21*l* that is molded integral with leg 21*b*. The tongue 21*l* projects centrally of window 21*k*, and has an enlarged, head 21*n*, as seen in each of FIGS. 1–3. By applying a lateral force to head 21*n*, in a direction transverse to the plane of the web section 21*d*, as seen in FIG. 1, said head will be moved out of the plane of web section 21*d*, so that the free edge 18*a* of shower curtain 16 can be slipped past enlarged head 21*n*. When the head 21*n* is released, the tongue 21*l* is restored, by the resiliency of the material of the tongue, to its initial position as seen in FIG. 1, and the enlarged head 21*n* then engages the inner surface of curtain 18 and tends to move a portion of curtain 18 through window 21*k*, thereby using the tongue 21 *n* and window 21*k*, as a gripping means for holding curtain 18 closely adjacent a portion of the web 21*d* of plastic body 20, and thereby holding the shower curtain closely adjacent the upright wall 16 to which the splash guard 20 is attached.

The gusset, or pleat, seen in FIGS. 1–3 and shown in cross-section in FIGS. 4–6, illustrates how the web of the plastic body of the splash guard accommodates the compression of body 20, as shown in FIG. 2, or the expansion of body 20 as seen in FIG. 3.

From the foregoing description, one skilled in the art will be advised of the features of construction of our new and improved shower splash guard and shower curtain holder that is provided as a unitary body.

While we have shown and described a particular embodiment of this invention, it will be obvious to those skilled in the art that various changes and modification may be made therein without departing from the spirit and scope of the invention and, therefore, it is intended in the appended claims to cover all such changes and modifications which fall within the true spirit and scope of this invention and its disclosure.

What is claimed is:

1. For use with the existing combination of a shower-equipped tub for a bathroom, in which a person who is showering stands while showering, and where one end of said tub is located adjacent to a generally upright end wall that at least partially bounds the region above the tub; the tub providing a horizontal upper edge positioned in a substantially vertical plane, and with a flexible shower curtain being provided, suspended from a support spaced above the tub, with said curtain's lowermost end extending downwardly to enter into the confines of the tub, and functioning to limit water splash within the tub from migrating to a region outwardly of the tub;

the improvement of providing a shower splash guard member for limiting water splash from migrating outwardly of the tub to be deposited onto a bathroom floor surface that is located adjacent the tub;

said splash guard member comprising, in combination, a unitary shower splash guard member, that is molded of plastic and is constructed to provide a pair of orthogonally arranged mounting legs that are joined together by a web which is formed integral with, and which extends between, said mounting legs; a first of said mounting legs being adapted to overlie a portion of a horizontal upper edge of the tub wall that is spaced above a bathroom's floor; said splash guard member providing a second mounting leg that projects upwardly relative to said first mounting leg and which is positioned to lie adjacent to, and being adapted to be secured to, said upright end wall;

an opening being provided extending through said web, and being located adjacent to said second mounting leg; a tongue extending from said second mounting leg in a direction away from the second mounting leg and projecting into said opening that extends through said web, said tongue and said opening into which the tongue projects cooperating to provide a means for gripping a portion of a shower curtain, by friction developed between the tongue and the shower curtain and between the web and shower curtain and being operative to hold the shower curtain in a selected position against the web of the splash guard member and against the tongue of the splash guard member.

2. A construction as in claim 1 wherein said pair of mounting legs of the splash guard member are joined at a vertex of said splash guard member defined by the junction of adjacent ends of said mounting legs.

3. A construction as in claim 2 wherein the web of the splash guard member is shaped to provide a molded gusset section that extends from said vertex of the splash guard member to a portion of the free edge of the web that is closest to and opposite from said vertex, whereby to provide an expansion joint means which accommodates variations in the angular attitude of the upright wall to which a portion of the splash guard member attaches.

4. A construction as in claim 1 wherein an elongated adhesive strip is secured along substantially the entire aggregate length of the two mounting legs of the splash guard member, so as to provide means for adhesively securing each mounting leg to a member to which the mounting leg is to attach.

5. A construction as in claim 3 wherein the molded gusset section includes a set of grooves extending radially of the vertex of the splash guard member to provide fold lines to accommodate accordion-like folding, or unfolding, of radially extending segments of the web of the splash guard member, as is required by the included angle subtended between the pair of mounting legs of the splash guard member.

* * * * *